US006701693B2

(12) United States Patent
Benard et al.

(10) Patent No.: US 6,701,693 B2
(45) Date of Patent: Mar. 9, 2004

(54) SYSTEM FOR THE OPTIMALIZED CLOSURE OF ENVELOPE FLAPS

(75) Inventors: Serge Benard, Bois-Colombes (FR); Olivier Galtier, Saint-Fargeau Ponthierry (FR); Stéphane Le Gallo, Igny (FR)

(73) Assignee: Neopost Industrie, Bagneux (FR)

( * ) Notice: Subject to any disclaimer, the term of this patent is extended or adjusted under 35 U.S.C. 154(b) by 133 days.

(21) Appl. No.: 09/766,601

(22) Filed: Jan. 23, 2001

(65) Prior Publication Data

US 2001/0010143 A1 Aug. 2, 2001

(30) Foreign Application Priority Data

Jan. 28, 2000 (FR) ..... 00 01110

(51) Int. Cl.[7] ..... B65B 51/10; B65B 7/20

(52) U.S. Cl. ..... 53/377.6; 53/378.3; 53/569

(58) Field of Search ..... 53/569, 402, 284.3, 53/381.5, 383.1, 376.3, 378.3, 377.6, 377.4; 493/231, 244, 264

(56) References Cited

U.S. PATENT DOCUMENTS 1,173,264 A * 2/1916 Hall
2,015,507 A * 3/1935 Arnold et al. ..... 156/422.1
2,609,790 A * 9/1952 Uhl ..... 118/603
2,944,511 A * 7/1960 Bach et al. ..... 118/243
4,075,821 A * 2/1978 Cavell ..... 156/443
4,450,037 A * 5/1984 Gavronsky ..... 118/32
5,058,363 A * 10/1991 Focke et al. ..... 53/202
5,155,973 A 10/1992 Hipko et al.
5,651,238 A 7/1997 Belec et al.
5,702,098 A 12/1997 Gottlieb et al.
5,899,050 A * 5/1999 Bergwerf ..... 493/23

FOREIGN PATENT DOCUMENTS

EP 0 604 918 A1 7/1994

* cited by examiner

*Primary Examiner*—Rinaldi I. Rada
*Assistant Examiner*—Paul Durand
(74) *Attorney, Agent, or Firm*—Sughrue Mion, PLLC

(57) ABSTRACT

This invention relates to a supply module in a mail processing machine including a conveyor for conveying the mail-pieces and a moistening device ensuring wetting of a flap of an envelope after the latter has been slightly moved apart from the body of the envelope, as well as a device for creating on said flap of the envelope a second line of fold above the natural crease line of the envelope existing at the level of the join of the body of the envelope with the flap.

10 Claims, 4 Drawing Sheets

FIG.4A
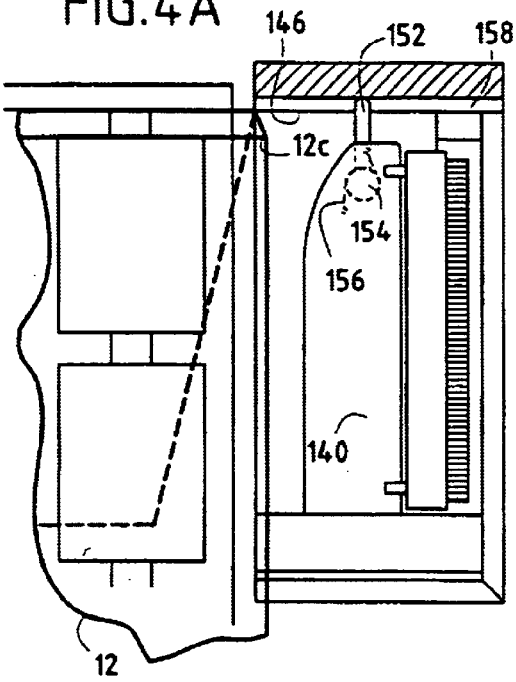
FIG.4B
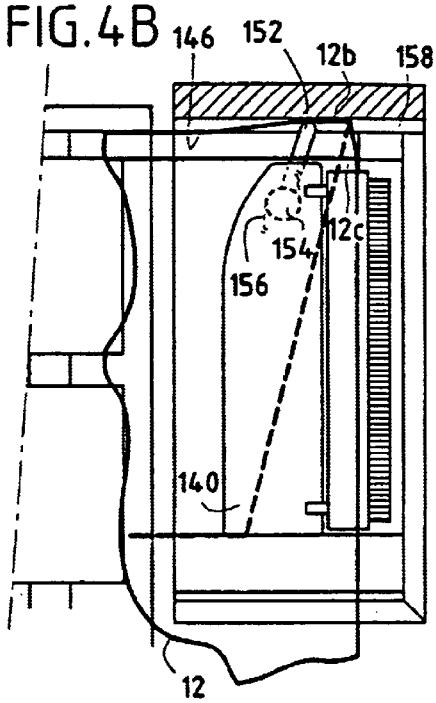
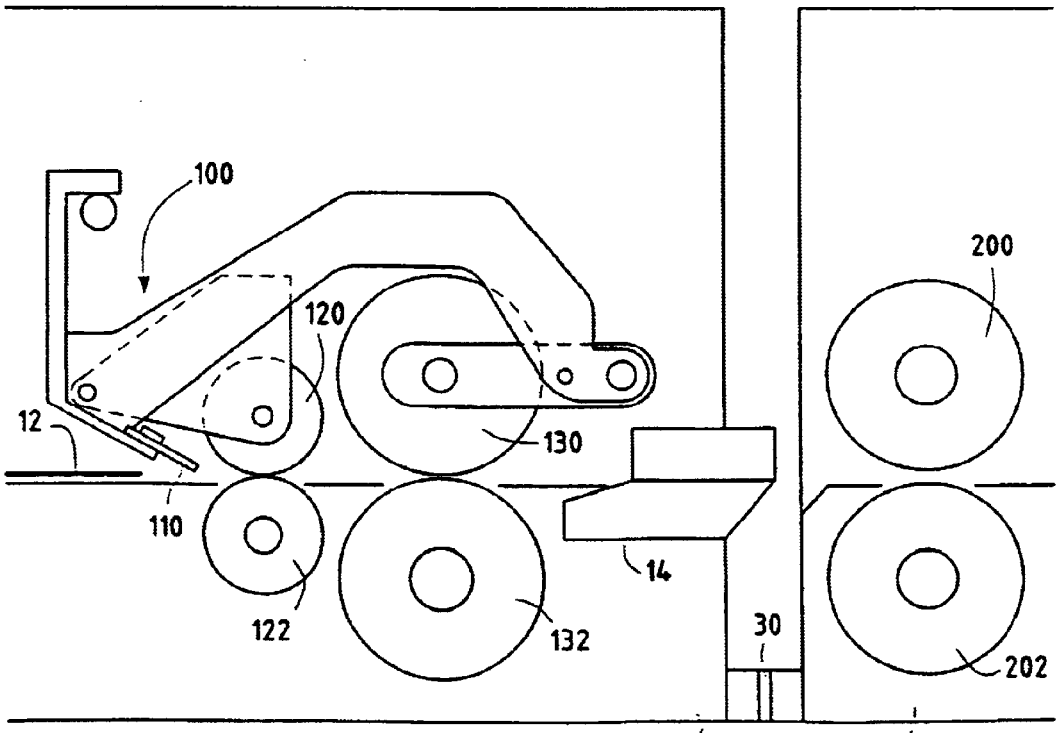
FIG.6 PRIOR ART

SYSTEM FOR THE OPTIMALIZED CLOSURE OF ENVELOPE FLAPS

FIELD OF THE INVENTION

The present invention concerns the field of mail processing and relates to a module for supplying mailpieces provided with a device for closing envelope flaps, particularly adapted for thick envelopes.

BACKGROUND OF THE INVENTION

As shown very schematically in FIG. 6, envelope flaps are conventionally closed in a traditional mail processing machine by the pressure of gripping means at the entrance of a franking module 10 or any other module of this machine (most often an extraction module or possibly a weighing module) disposed immediately downstream of a supply module 10 in which these flaps were previously wetted by a moistening device 14 disposed at the outlet of this module on the path along which the mailpieces are conveyed.

Unfortunately, the simplicity of this envelope flap closure system is not without numerous shortcomings. In effect, the inventors observed in particular that, with this system, the envelope, although closed, is not closed correctly as the flap which was previously moistened is folded abnormally and damaged or even partially torn when the envelope emerges from the mail processing machine. FIGS. 3 to 5 of French Patent Application No. 98 14757 filed earlier by Applicants show examples of shortcomings encountered in day-to-day practice of a mail-sorting and -dispatching service.

Of course, such a deformation of the envelope is particularly critical, as the disturbance of its longitudinal jamming along the transport path creates defects at the level of printing of the postal indicia which is then no longer printed perfectly horizontally (a horizontal line will in that case be shown in the form of a wavy line).

Now, the consequences of such defects both in the closure of the envelopes and in the printing of the indicia are considerable (especially if these envelopes are full and in that case very thick), insofar as the damaged envelope or one whose postal indicia is deformed risks being rejected by the Postal Administration.

It is an object of the present invention to overcome these shortcomings in the closure of the envelopes by proposing a mailpiece supply module provided with a device, both simple and reliable, facilitating closure of the flaps of envelopes of considerable thickness. Another object of the invention is to propose a device which can also be employed with envelopes of smaller thickness (of nominal thickness) but of which the documents contained therein have been improperly inserted. Yet another object of the invention is to propose a device which allows a closure of the envelopes without employing complementary outside means. A further object of the invention is to propose a device which does not increase the initial space requirement of the supply modules and even one which reduces such space requirement.

SUMMARY OF THE INVENTION

To that end, the invention relates to a module for supplying filled envelopes in a mail processing machine comprising at least means for conveying these envelopes and a moistening device ensuring wetting of a flap of an envelope after said flap has been slightly moved apart from the body of the envelope, characterized in that it further comprises means for creating on said flap of the envelope a second line of fold above the natural crease line of the envelope existing at the level of the join of the body of the envelope with the flap.

The presence of these means for creating a second fold in the flap of the envelope makes it possible to close the latter without deformation and consequently to facilitate moistening and closure thereof by gripping cylinders arranged downstream.

According to a first embodiment, these means for creating a second line of fold comprise a pivoting blade of which a free end is intended to cooperate with a horizontal notch made in the body of the moistening device opposite this blade end, so as to "break" the flap of the envelope during its passage in the moistening device. The pivoting blade is advantageously mounted on this moistening device at the level of a separator intended to ensure, before wetting, the spacing of the flap with respect to the body of the envelope.

According to a second embodiment the means for creating a second line of fold comprises a pivoting separator of which a free end is extended in order to cooperate with a horizontal notch made in the body of the moistening device opposite this separator end, so as to "break" the flap of the envelope during its passage in the moistening device.

Furthermore, the supply module preferably comprises cylinders for gripping and extracting the mailpiece disposed just downstream of the moistening device and intended to ensure the closure of the envelope by pressure. The gripping/extraction cylinders are mechanically connected to said envelope conveying means via a movement transmission mechanism. This movement transmission mechanism preferably comprises means for transmitting the spacing of said conveying means to said gripping/extraction cylinders as a function of the thickness of the filled envelope and according to a predetermined ratio of reduction.

The gripping/extraction cylinders are advantageously either each associated with a roller having the same axis but of slightly larger diameter and intended firmly to mark the second crease line during passage of the envelope between the gripping/extraction cylinders, these rollers in that case preferably being made of a sliding material, or one of these gripping/extraction cylinders is associated with a first roller having the same axis and same diameter, a second pivotally mounted roller being intended to cooperate with this first roller in order firmly to mark the second crease line during passage of the envelope between the gripping/extraction cylinders.

The invention also relates to a mail processing machine comprising such a supply module. This may be a franking machine, or a folding and insertion machine.

BRIEF DESCRIPTION OF THE DRAWINGS

The invention will be more readily understood on reading the following description given by way of non-limiting example, with reference to the accompanying drawings, in which:

FIGS. 4*a* and 4*b* illustrate in plan view two successive positions of an envelope passing at the level of the moistening device.

FIG. 6 illustrates in longitudinal section a supply module of the prior art of a conventional mail processing machine.

DESCRIPTION OF PREFERRED EMBODIMENT

Figure 1A:
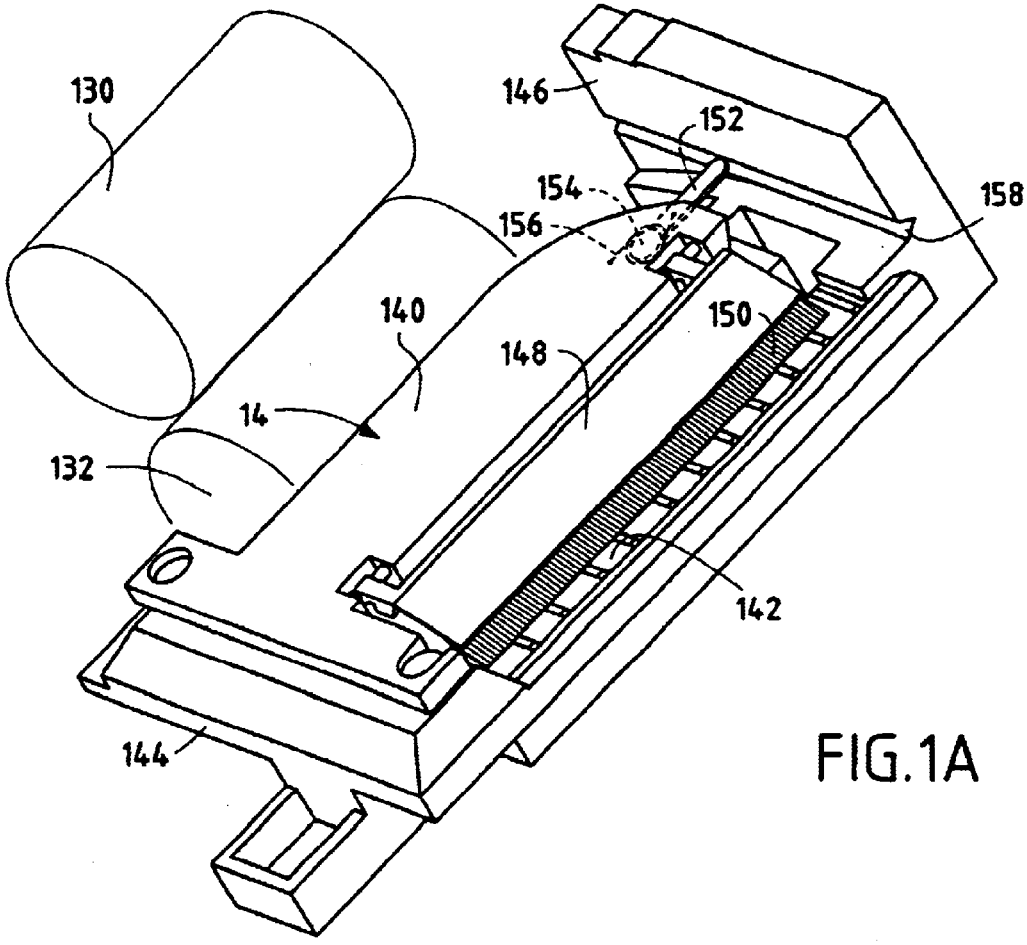
FIGS. 1*a* and 1*b* respectively show in perspective and in section a preferred embodiment of a moistening device employed in a supply module according to the invention.

Referring again to the drawings, FIG. 6 very schematically illustrates two of the principal components of a mail processing machine, the first being a module 10 for supplying mailpieces 12 provided with its means 100 for separating the mailpieces (in particular a die 110 and selection cylinders 120, 122) and with its means for conveying the mailpieces one by one, for example two superposed drive cylinders 130, 132, and the second being a module 20 for franking the mailpieces provided with printing means (not shown) and its means for conveying the mailpieces one by one, in particular two superposed gripping cylinders 200, 202, mounted at the entrance of this module.

According to the configuration envisaged for the mail processing machine, the franking module may be preceded by a dynamic weighing module or more generally by an extraction module (or the two), the gripping cylinders 200, 202 shown in FIG. 5 in that case having to be considered as being those of one or the other of these two modules. In a variant embodiment, these gripping cylinders may be simply replaced by belts. In addition, connection means 30 are provided at the level of each of these two modules in order to ensure a mechanical connection and a continuity of the electrical connections within the mail processing machine (these connection means defining a non-zero minimum space between the two modules).

Moreover, the supply module very conventionally comprises, at its outlet, a moistening device 14 for wetting the flap of the envelopes 12 which will then be closed during their subsequent passage through the gripping cylinders of the module 10 which immediately follows this supply module 10, whether it is an extraction module (in which case they would be referred to as extraction cylinders), a dynamic weighing module, or a franking module.

Figure 5A:
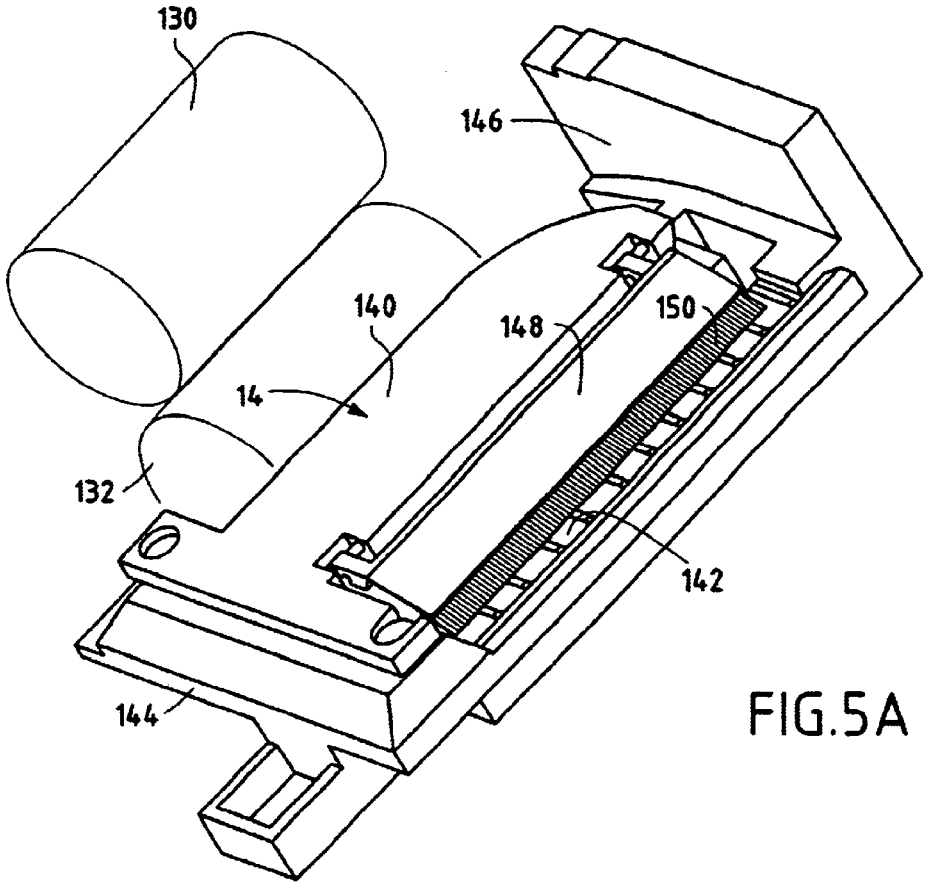
FIG.5A PRIOR ART
FIGS. 5*a* and 5*b* respectively show in perspective and in section a moistening device of the prior art employed in a supply module of a conventional mail processing machine.
Figure 5B:
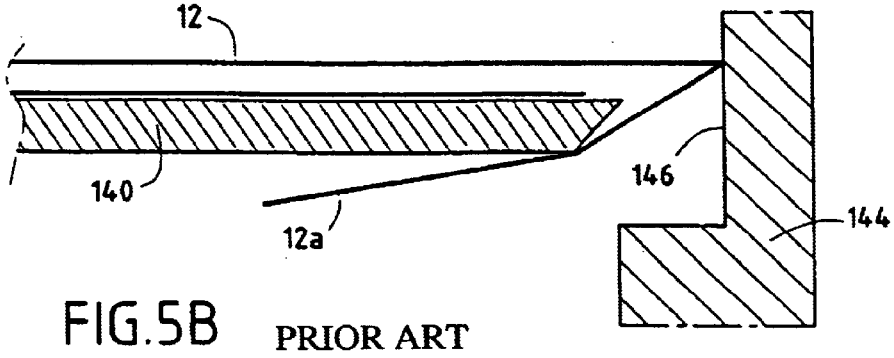
FIG.5B PRIOR ART

Such a conventional moistening device is now described with reference to FIGS. 5*a* and 5*b* which show it in perspective and in a partial transverse section, respectively.

This device, disposed along the path of transport of the mailpieces, downstream of the conveyor cylinders 130, 132, is conventionally formed by a separator 140 and a wetting tank 142 which are both mounted in a body 144 of this device of which a vertical wall 146 parallel to the direction of transport of the mailpieces 12, forms a reference face for laterally guiding (aligning) the envelopes. The separator comprises a fixed part fast with the body 144 and an articulated part 148 on which is mounted a brush 150 whose bristles, directly in contact with the wetting tank 142 in the absence of envelopes, then moisten the inner part 12*a* of the flap of these envelopes after the latter has been separated from the body of the envelope by the separator 140 (cf. FIG. 5*b*).

Of course, this mail processing machine comprises other components, both mechanical (for example supply bin) and electronic (control and monitoring means). However, it is unnecessary to describe them in order to illustrate the present invention and, consequently, they will not be described nor shown.

As set forth in the preamble, the inventors observed that such a conventional mail processing machine was not without shortcomings, particularly at the level of closure of the envelope flaps. After Multiple tests, they observed that these shortcomings were all the more marked as these envelopes were thick or were filled with improperly inserted documents.

The inventors thus imagined a supply module whose moistening device is modified in order to facilitate closure of the flaps of these envelopes. They also sought to improve the guiding of the envelope and in particular to eliminate, or at least limit, the micro-shocks undergone by the envelope in its transport from the supply module towards the module immediately following, for example an extraction module, at the level of the lower extraction cylinder 202 of this second module 20.

Figure 1B:
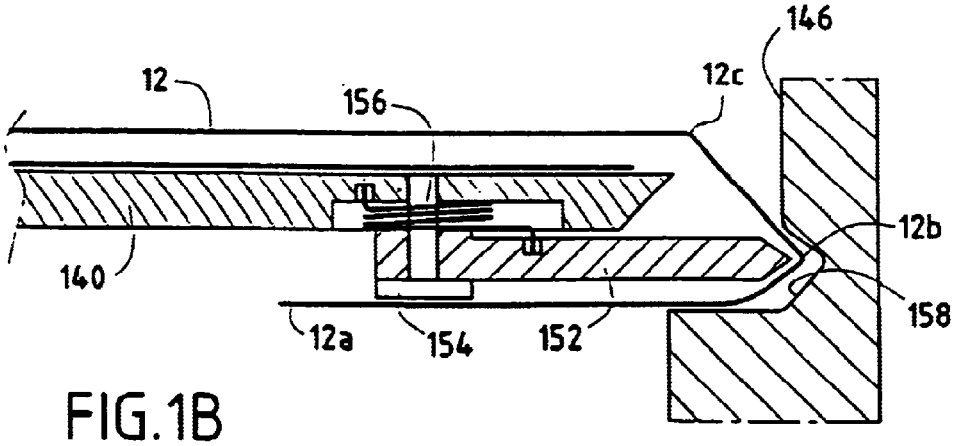

Firstly, according to the invention, and as illustrated in FIGS. 1*a* and 1*b*, means 152 are proposed, intended to create on the flap 12*a* of the envelope, a second line of fold 12*b* above the natural crease line 12*c* of the envelope originally existing at the level of the join of the body of the envelope 12 with its flap 12*a*.

To that end, the separator 140 of the moistening device 14 may be provided with a pivoting blade or knife 152 associated with a pivot pin 154 and a torsion spring 156 whose two ends are respectively fixed in the body of the separator 140 and in the blade 152 and whose function is to return the blade into its original position of equilibrium. Moreover, the vertical surface for laterally aligning the envelope 146 forming fold-guide presents a horizontal notch 158 made opposite the end of the blade 152 so as to "break" the flap 12*a* of the envelope upon its passage on the separator 140 while ensuring a presser effort thereon.

This second fold 12*b* offset from the natural crease of the envelope 12*c* and made before this envelope leaves the supply module, guarantees a complete closure of the filled envelope and thus overcomes the problems both of crooked insertion of the envelope and of jamming at the entrance of the module immediately following. In addition, it makes it possible better to control the curvature of the flap with a view to an optimalized closure as a function of the thickness of the envelope, as will be described in greatear detail.

It is then proposed to integrate in the supply module 10 the pair of gripping/extraction cylinders usually arranged at the entrance of the franking module (or of any other module) and to mount it just downstream of the moistening device 14. In this way it becomes possible to do without a possible extractor module usually disposed at the exit of the supply module and to furnish an accelerated conveyor speed via appropriate movement control kinematics.

In addition, by ensuring that the flap is definitively closed on leaving the supply module, its possible re-opening due to its elasticity (it having been improperly closed due to a document inserted crooked in the envelope, for example) or simply due to gravity during its transfer from the supply module to the following module, is avoided.

Figure 2:
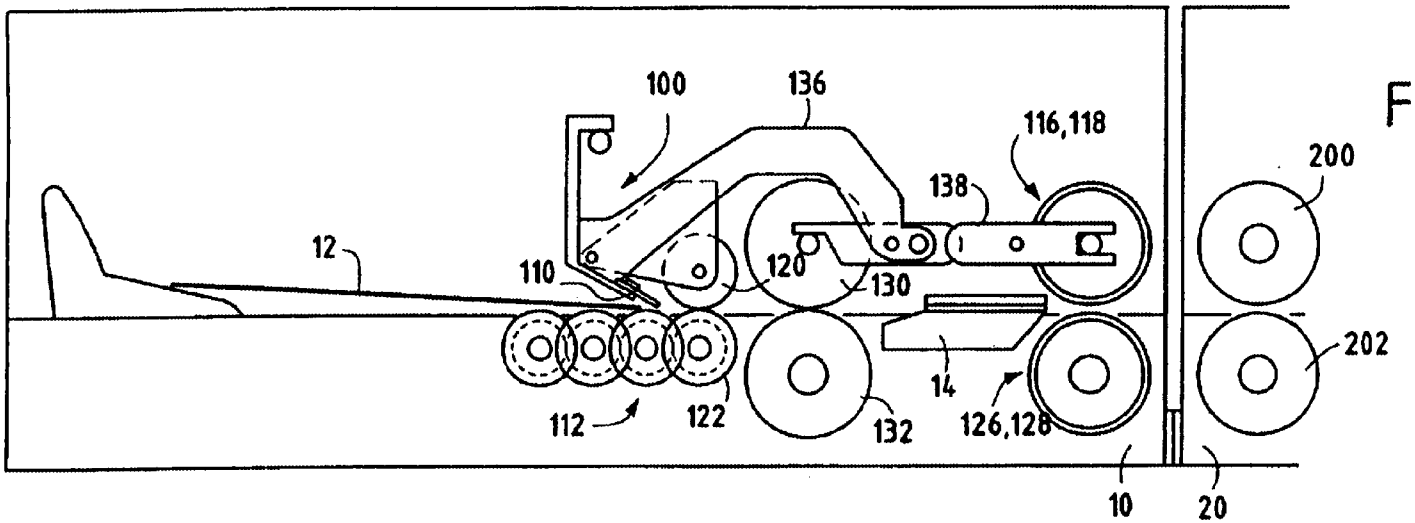
FIG. 2 illustrates in longitudinal section a supply module according to the invention.

An envelope supply module of a mail processing machine incorporating the above characteristics of the invention is schematically illustrated in FIG. 2.

This module comprises a series 112 of drive cylinders which directs the envelope 12 (slightly inclined and aligned at the rear) towards and beneath the selection mechanism 100. A conveyor device conventionally comprising in particular a presser assembly 136 and conveyor cylinders 130, 132, ensures conveyance and ejection of the envelope (after passage through the moistening device 14) out of the supply module 10 towards the module 20 immediately downstream, for example a dynamic weighing module, more generally an extraction module or a franking module.

According to the invention, gripping/extraction cylinders 116, 126 are mounted just downstream of the moistening device 14 and are mechanically connected to the conveyor cylinders 130, 132 and to the presser assembly 136 by a movement transmission mechanism 138.

This mechanism 138 makes it possible to transmit the spacing between the conveyor cylinders 130, 132, depending on the thickness of the filled envelope 12, to the gripping/extraction cylinders 116, 126 in a determined ratio of reduction. This ratio is chosen in order simultaneously to obtain:

the taking into account of a variable envelope thickness; and the maintenance of a sufficient pressure in order to progressively apply the flap of the envelope against its body.

Figure 3B:
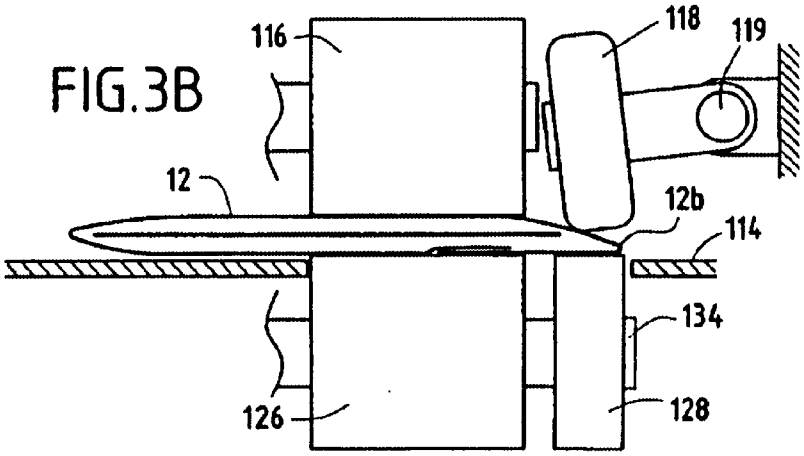
FIGS. 3*a* and 3*b* show in two distinct embodiments an end view of FIG. 2.
Figure 3A:
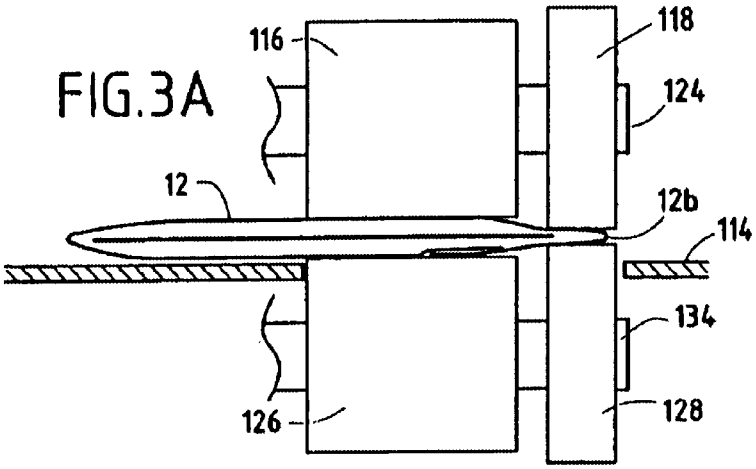

In addition, in order not to disturb functioning of the pair of gripping/extraction cylinders, there is associated therewith a mechanism for marking the second fold formed, as illustrated by the examples of FIGS. 3*a* and 3*b*, by a pair of rollers 118, 128 coupled or not to these cylinders 116, 126.

According to the embodiment of FIG. 3*a*, the lower roller 128, like cylinder 126 is driving (borne by the same pin 134) but, in order not to disturb functioning of this driving cylinder 126, it is made of a sliding material and presents a slightly greater diameter. It may also be replaced by a "swelling" of the table 114, without angular edge, and whose height is greater than the difference in levels existing between the plane of this table and the bearing plane of the envelope on the lower gripping cylinders 126. As for the upper roller 118, it is also borne by the same pin 124 as the upper cylinder 116 and it also presents a slightly greater diameter.

According to the embodiment of FIG. 3*b*, the lower and upper rollers are now of the same diameters as the gripping/extraction cylinders (and made of the same material) and only the lower roller 128 is fast with the lower cylinder 126. On the other hand, the upper roller 118 now acts as presser device independent of that of the counter-cylinder 116 and of which the support pin is connected by a pivot member 119 to the body of the supply module 10.

The functioning of the supply module according to the invention will now be described with reference to FIGS. 4*a* and 4*b*. The filled envelopes inserted one by one in the supply module from a loading bin are directed towards the separator 140 of the moistening device 14 where the flap 12*a* is firstly spaced apart from the body of the envelope 12 before the second crease line 12*b* is created by the cooperation of the blade 152 and the opposite notch 158 (a rear part of the envelope remaining engaged between the conveyor cylinders 130, 132), the return spring 156 acting against the advance of the envelope promoting the marking of the fold. Simultaneously, the flap 12*a* is moistened by the brush 150. The envelope is then extracted by the gripping/extraction cylinders 116, 126 between which it is closed then directed out of the supply module. At the same time (i.e. during the passage of the envelope between the gripping/extraction cylinders), the second fold 12*b* is marked very firmly by the rollers 118, 128.

The closure of the flap as soon as it is moistened is important in order to avoid the subsequent problems of jamming. Once the envelope has been closed, the gripping cylinders 200, 202 at the entrance of the following module will "confirm" this action of closure by applying an effort of compression which will definitively seal the flap of the envelope. The prior closure of the envelope (by the cylinders 116, 126) renders this final effort less critical, in particular for thick envelopes which always undergo successive micro-shocks on contact with these second gripping cylinders.

Such confirmation of closure may be effected in known manner either in an extractor module (when there is one, but its presence becomes less indispensable due to the gripping/extraction cylinders which already perform a function of extraction), or directly in a franking module via a pair of extractor or gripping cylinders. It may also be followed by a second and a third confirmation step depending on the number of modules constituting the mail processing machine, the second step taking place for example in a dynamic weighing module and the third in the franking module.

It is obvious that the invention is not limited to the preferred embodiment described and that it is perfectly possible to envisage means for creating the second fold whose stricture is different from that described hereinabove. In particular, it is possible to provide for these means an entirely pivoting separator which is in that case no longer fast with the body of the moistening device but articulated thereon, the blade being in that case replaced by a transformation of the separator 140 whose free end is extended. In that configuration, the fold is marked by this thin end of the separator which will cooperate with the opposite notch 158 of the moistening device in place of the pivoting blade 152.

Similarly, when it is not necessary to print the postal indicia, or when this is to be effected subsequently, as in a folding and insertion machine, the second crease line may be created directly, without the prior use of the pivoting knife, while the envelope is being crushed by the closure rollers 118, 128. However, in that case, this second fold is not perfectly rectilinear but depends on the filling of the envelope.

What is claimed is:

1. A module for supplying filled envelopes in a mail processing machine comprising:

means for conveying said envelopes;

a moistening device ensuring wetting of a flap of one of said envelopes after said flap has been slightly moved apart from a body of the envelope; and means for creating on said flap of the envelope a second line of fold above the natural crease line of the envelope existing at the level of the join of the body of the envelope with the flap.

2. The supply module of claim 1, wherein said means for creating said second line of fold comprises:

a pivoting blade of which a free end cooperates with a horizontal notch in the body of the moistening device opposite the blade end, to break the flap of the envelope during a passage of said envelope in the moistening device.

3. The supply module of claim 2, wherein said pivoting blade is mounted on the moistening device at the level of a separator to ensure, before wetting, the spacing of the flap with respect to the body of the envelope.

4. The supply module of claim 1, wherein said means for creating said second line of fold comprises:

a pivoting separator of which a free end cooperates with a horizontal notch made in the body of the moistening device opposite the separator end to break the flap of the envelope during a passage of the envelope in the moistening device.

5. The supply module of claim 1, further comprising:

mailpiece gripping extraction cylinders disposed downstream of the moistening device and ensuring closure of the envelope by pressure.

6. The supply module of claim 5, wherein said gripping/extraction cylinders are mechanically connected to said envelope conveying means via a movement transmission mechanism.

7. The supply module of claim 6, wherein said movement transmission mechanism comprises means for transmitting the spacing of said conveying means to said gripping/extraction cylinders as a function of the thickness of the filled envelope and according to a predetermined ratio of reduction.

8. The supply module of claim 5, wherein said gripping/extraction cylinders are each associated with a roller having the same axis but of slightly larger diameter and intended firmly to mark the second line of fold during passage of the envelope between the gripping/extraction cylinders.

9. The supply module of claim 8, wherein said rollers are made of a sliding material such that a surface of the envelope is capable of sliding over said sliding material with substantial minimal friction.

10. The supply module of claim 5, wherein one of the mailpiece gripping extraction cylinders is associated with a first roller having the same axis and same diameter, a second pivotally mounted roller being intended to cooperate with this first roller to firmly mark the second line of fold during passage of the envelope between the mailpiece gripping extraction cylinders.

* * * * *